United States Patent [19]

Patton

[11] 4,112,452

[45] Sep. 5, 1978

[54] APPARATUS FOR PROCESSING PHOTOGRAPHIC FILM

[75] Inventor: David Lynn Patton, Webster, N.Y.

[73] Assignee: Eastman Kodak Company, Rochester, N.Y.

[21] Appl. No.: 774,721

[22] Filed: Mar. 7, 1977

[51] Int. Cl.[2] ..... G03D 3/04

[52] U.S. Cl. ..... 354/322; 354/330; 354/340; 134/79; 134/166 R; 366/331

[58] Field of Search ..... 354/312, 313, 314, 315, 354/316, 318, 319, 320, 321, 326, 328, 329, 330, 331, 333, 335, 337, 340; 134/64 P, 76, 78, 79, 80, 82, 122 P, 137, 153, 166 R; 366/331

[56] References Cited

U.S. PATENT DOCUMENTS

| | | | |
|---|---|---|---|
| 608,871 | 8/1898 | Kirkwood | 134/139 |
| 750,621 | 1/1904 | Dorr | 354/316 |
| 833,626 | 10/1906 | Pifer | 354/322 |
| 1,185,191 | 5/1916 | Garland | 354/316 |
| 2,545,031 | 3/1951 | Izzi | 134/71 |
| 3,335,839 | 8/1967 | Neumann | 134/76 X |
| 3,349,686 | 10/1967 | Buechner | 354/341 |
| 3,528,760 | 9/1970 | Buechner | 354/341 |
| 3,641,906 | 2/1972 | Orr | 134/142 |
| 3,739,706 | 6/1973 | Carstens | 134/82 |
| 4,011,573 | 3/1977 | Braico | 354/329 |

*Primary Examiner*—L. T. Hix
*Assistant Examiner*—Alan Mathews
*Attorney, Agent, or Firm*—J. A. Mathews

[57] ABSTRACT

An apparatus for automatically processing photographic film disks immerses the disks in a plurality of baths of treatment solutions, one bath after another, spins the disks about a horizontal axis of rotation during successive immersions to agitate the disks in the baths, and spins the disks between successive immersions to remove excess solution from the disks. A horizontally supported spindle is used to accumulate the disks for high density processing, while a transport mechanism conveys the spindle between the baths and between first and second rotary drives to agitate and remove the excess solution from the disks, respectively, in accordance with an appropriate processing sequence.

12 Claims, 4 Drawing Figures

APPARATUS FOR PROCESSING PHOTOGRAPHIC FILM

CROSS-REFERENCE TO RELATED APPLICATIONS

Reference is made to commonly-assigned copending U.S. patent application Ser. No. 774,722, entitled METHOD AND APPARATUS FOR TREATING ELEMENTS OF PHOTOGRAPHIC FILM; Ser. No. 774,716, entitled PHOTOGRAPHIC FILM UNIT AND CARTRIDGE ASSEMBLY; Ser. No. 774,715, entitled PHOTOGRAPHIC CAMERAS; is an improvement over the invention disclosed in cross-referenced application Ser. No. 774,722, all filed in the name of Donald M. Harvey on even date herewith, and to Ser. No. 774,717, entitled IMPROVED ROTARY FILM PROCESSING APPARATUS; Ser. No. 774,720, entitled IMPROVED VERTICAL PROCESSING APPARATUS, both filed in the name of William J. Hutchinson, and Ser. No. 774,718, entitled IMPROVED HORIZONTAL FILM PROCESSING APPARATUS filed in the name of Victor C. Solomon, all filed on even date herewith, now abandoned.

BACKGROUND OF THE INVENTION

The present invention, Ser. No. 774,719, entitled APPARATUS FOR SELECTIVELY VIEWING A PLURALITY OF RECORDING ELEMENTS, relates to automated photo finishing equipment and to processors that establish visually perceivable or projectable images from latent images in photographic material such as film. More specifically the invention relates to rack-and-tank processors having particular utility with film disks or with individual units of relatively stiff photographic material having a generally flat circular profile.

Rack-and-Tank Processors

Rack-and-tank processors usually include a plurality of tanks of chemical solutions, a rack for supporting photographic film, and a transport for conveying the rack from tank-to-tank successively to immerse the film in the solutions. The solutions are agitated by mixing vanes, bursts of nitrogen gas, or the like, while intersolution contamination is reduced by dripping excess solution from the film between its successive immersions. Examples of such processors are disclosed in U.S. Pat. Nos. 1,863,689; 2,545,031; 2,557,307; 3,335,839; 3,469,517; 3,724,343 and 3,739,706.

Although rack-and-tank processors have been used successfully for many years, they are large in size and somewhat cumbersome in operation, requiring a substantial capital investment and space allocation. While essentially fail-safe and very flexible in operation, they use undesirably high volumes of processing solutions, and are relatively slow, mainly because of the time used in transporting the film from one tank to another. Perhaps most notable are problems associated with the various approaches used for agitation and for removing excess solution from the film between immersions.

Agitation and the removal of excess solution are important to the speed, quality and uniformity of processing. Agitation mixes the solutions, enhances the migration of various chemicals at the film-solution interface, and removes pockets of solution which may be starved of chemicals. The removal of excess solution reduces intersolution contamination, spotting of the film and uneven processing. It also permits higher drying temperatures without introducing craters or furrows in the emulsion surface.

Film-disk Processors

Film disks of the type with which the present invention has particular utility are not popular today. Circular film configurations are described in earlier patents, however, including U.S. Pat. Nos. 509,841; 1,434,026; 1,722,573; 1,773,106; 2,494,495; 2,446,200; 2,531,651; 2,531,652; and 2,531,653. A processor for film disks is depicted in U.S. Pat. No. 833,626. Other processors for circular film assemblies, or that rotate the film in some manner during processing, are disclosed in U.S. Pat. Nos. 750,621; 2,766,670; 3,724,353; and 3,882,527; and in the cross-referenced patent application Ser. No. 774,722.

Previously known photographic processors for disks and disk assemblies, or that rotate the film, have offered relatively compact structures and, in some cases, can be operated with a minimum investment. These devices, however, generally have not been conducive to high-volume automated production, lack the flexibility necessary for a wide range of applications, and typically have suffered from additional problems of their own. Agitation and the removal of excess solution often present problems similar to those mentioned above in connection with rack-and-tank processors. In other instances: (a) the disks are rotated too slowly to induce significant agitation; (b) the rotation is for agitation purposes only, omitting the advantages of centrifugal removal of excess solution; (c) the axis of rotation is vertically oriented, tending to trap bubbles during agitations or requiring faster rotation; or (d) the direction of movement during transport into and out of the solutions is normal to a flat dimension of the film, making rapid or high volume production difficult.

These and other problems that are alleviated by the present invention will become more apparent from an examination of the prior art in connection with the following description.

SUMMARY OF THE INVENTION

In accordance with the present invention, an automated rack-and-tank processor is provided which has particular utility with relatively stiff and generally flat photographic elements such as film disks. The processor is compact, compared to prior rack-and-tank processors, can be constructed with smaller tanks, employing reduced volumes of processing solutions, and permits quicker transfer of the film from tank-to-tank. The processor handles the disks automatically in a manner that facilitates immersion of the disks in the solutions, improves agitation of the immersed disks and more efficiently removes excess solution from the disks between successive immersions and before drying.

High-density processing is provided in accordance with one important feature of the present invention by accumulating the film disks, side-by-side, with their imaging surfaces in closely spaced parallel relation. Such an arrangement is surprisingly efficient in its use of tank space and solution chemicals, yet, when combined with improved agitation, is fully adequate to provide the necessary access of the chemicals to the photographic imaging surfaces.

In accordance with a preferred embodiment of the invention, the processor includes a spindle for accumulating the photographic disks in closely-spaced paralled relation, a plurality of baths of processing solutions in which the spindle and disks successively are immersible, an agitation drive for spinning the disks about a horizontal axis immersed in the solutions, a solution-removing drive for spinning the disks between successive immersions, and a transport for conveying the spindle and disks from tank-to-tank and from the agitation drive to the solution removing drive.

Still other aspects of the invention and more specific features will become apparent to those skilled in the art from the following description with reference to the accompanying drawings.

DESCRIPTION OF PREFERRED EMBODIMENT

Figure 1:
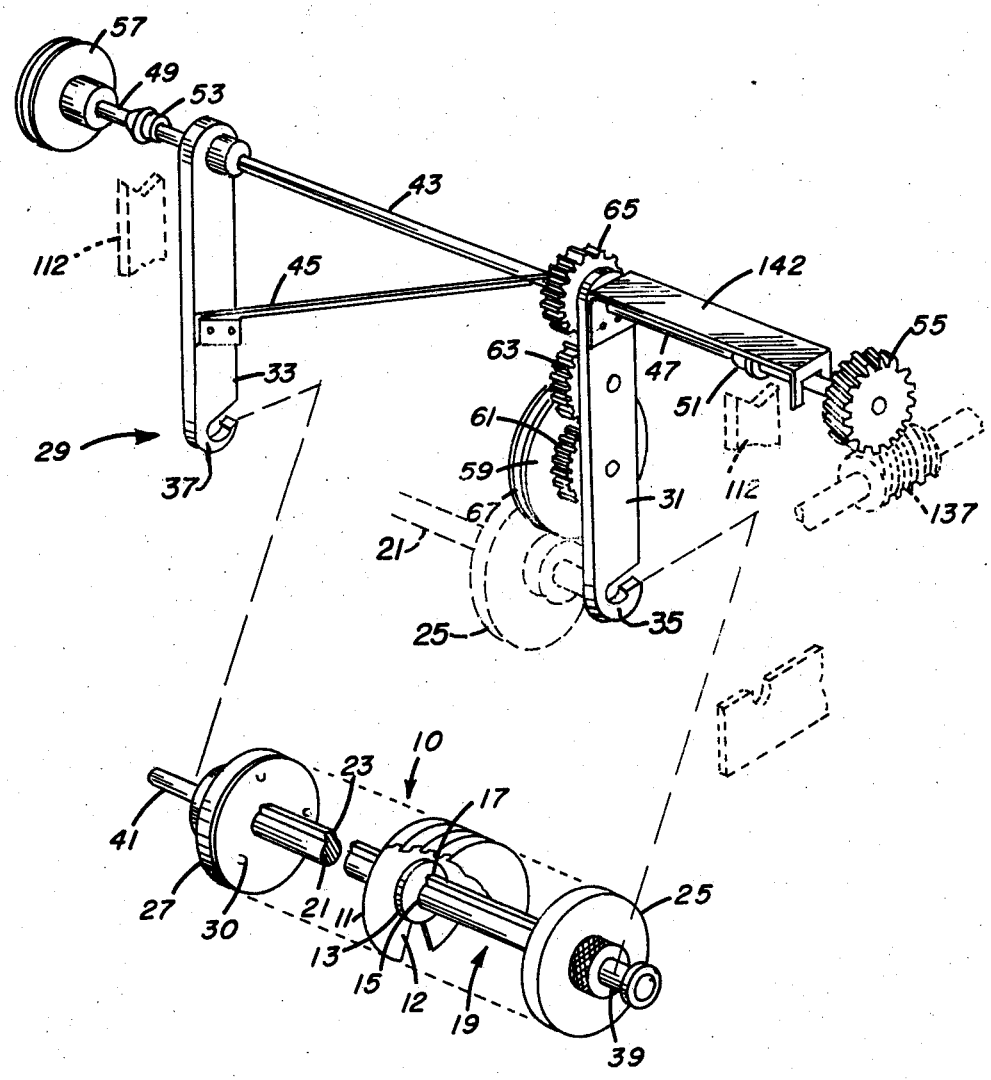
FIG. 1 is a partially exploded isometric view of a rack for use with the present invention, including a spindle or skewer for accumulating a plurality of film disks.

Referring now to the drawings, automatic apparatus is depicted in accordance with a preferred embodiment of the present invention for processing photographic material to establish from latent images, visually perceivable images, such as for direct viewing, projection or printing.

The apparatus has particular utility and will be described with disk-like film units having a centrally located aperture. Such a configuration is illustrated and described more fully in commonly assigned copending U.S. patent application Ser. No. 774,716, entitled PHOTOGRAPHIC FILM UNIT AND CARTRIDGE ASSEMBLY, filed on even date herewith in the name of Donald M. Harvey, the disclosure of which hereby is incorporated into the present application by reference. As there described, the film unit 10 includes a flexible but relatively stiff support disk 11 coated on one of its facing surfaces with a photosensitive emulsion, defining a dimensionally-stable and self-supporting imaging surface 12. The support disk is carried by a hub or core 13 which is somewhat thicker than the rest of the unit and defines an aperture 15 having an irregular cross-section of keyway 17. For purposes of the present description, it should be noted that the film unit is generally flat or planar in configuration, and that the aperture in the hub defines an axis of rotation normal to the plane of the imaging surface.

As depicted most clearly in FIG. 1, the processing apparatus includes a spindle or skewer 19 for accumulating a plurality of the film units on a common axis. The spindle comprises an elongate shaft 21 and key 23 which together define a length of constant cross-section dimensionally similar to the hub apertures 15 and keyways 17 to support the units for rotation coaxially with the spindle. Circular end caps 25 and 27 clamp to film units snugly together in side-by-side relation, but one or both of the caps is removable so the spindle can be inserted through the disks from one end, much like a skewer. The caps also provide a processing environment adjacent the endmost units which approximates that of the more centrally located units.

When clamped on the spindle, the support disks 11 are closely spaced relative to each other by the thickness of the cores 13, and relative to the end caps by hemispheric protrusions 30. Such spacing provides a compact or highly dense arrangement of film, yet maintains sufficient access to the imaging surfaces for processing. Supported in this manner, the film is sufficiently stiff to hold the required spacing when stationary or rotated.

The spindle 19 with its accumulated film units 10, is rotatably suspended during processing from a carrier or rack 29. Spaced hangers 31 and 33 of the carrier are notched at their distal ends 35 and 37 for rotatably supporting spindle end bearings 39 and 41.

The bearings and corresponding notches can be shaped to insure a one-way fit of the spindle in the rack. In the preferred embodiment, the bearing 41 is smaller in diameter than the bearing 39, and the notch in end 37 is too small to receive the larger bearing. Similarly, although not depicted in the drawings, the shaft key 23 and film keyway 17 can have an "L" shaped configuration to insure a one-way fit of the film disks on the spindle.

Ordinarily, there need be no concern over the orientation of the spindle relative to the carrier. A known orientation, however, can facilitate the employment of appropriate logic for sensing the position of one or both end caps, 27 and 25, thereby to determine the number of film units on the spindle, and then to control chemical replenishment rates, or the like, in accordance with the number of disks processed. Magnetic sensing means, assuming the end caps are metallic, and digital logic, are among the approaches suitable for this purpose.

The spindle hangers 31 and 33 are connected to the carrier by a tie-rod 43, a drip-bar 45, and, when in position, by the spindle itself. The tie-rod serves as a drive shaft and facilitates handling of the frame in the apparatus. For these purposes, as will become more apparent from the following description, the rod is extended beyond the hangers at 47 and 49 where it carries collars 51 and 53 and first and second drive couplers illustrated as a worm gear 55 and a pulley 57.

A mechanical transmission device, including a drive wheel 59 and a terminal gear 61 is pinned to one of the hangers 31. Gear 61 is part of a train 61, 63 and 65 for transmitting motion from the drive shaft 43 to a knurled portion of cap 25 and thence to the spindle 19. The drive wheel 59, which may include a high friction surface 67, transfers the driving force from the train to the knurled portion.

Figure 2:
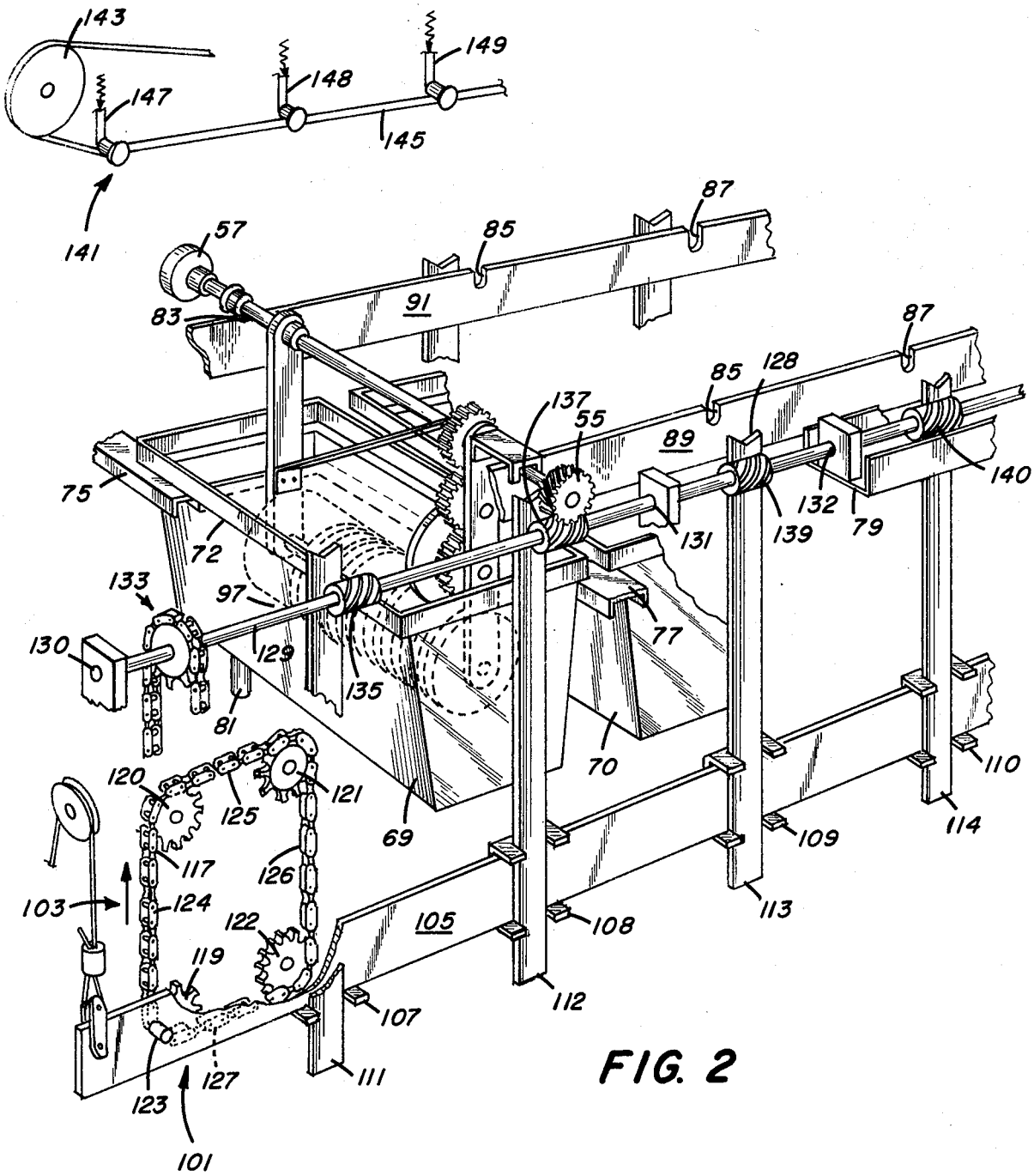
FIG. 2 is a partial perspective view of a processor in accordance with the present invention, including the rack of FIG. 1, a plurality of baths of chemical processing solutions, spin drives for agitating the film in the solutions and for removing excess solution from the film, and a transport for conveying the film between the respective baths and spin drives.
Figure 4:
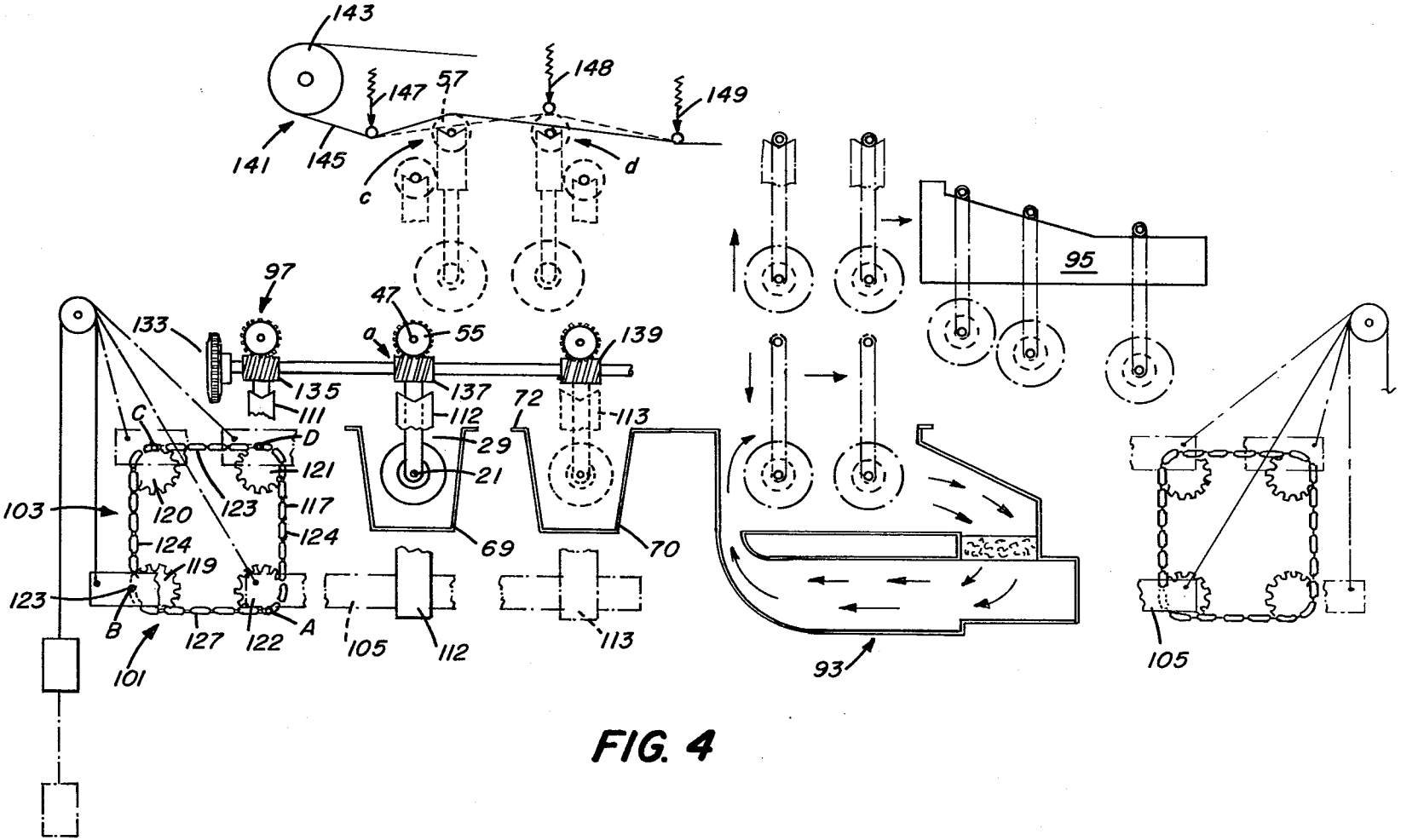
FIG. 4 is a broken schematic view depicting the processing sequence of the processor of FIG. 1.

Referring now to FIGS. 2 and 4, the processing apparatus includes a plurality of tanks or cells 69 and 70, which hold baths of chemical processing or photographic treatment solutions (perhaps including water). The tanks are configured and arranged for receiving the film units successively in one tank after another. As depicted, they are closely-spaced in-line and supported on a frame by engagement between lips 72 on the tanks and crossbars 75 and 77 of a frame 79. Appropriate replenishment pumps, overflows, valves, fluid lines, temperature controls, and the like, also are intended to be provided but are represented on the drawings only by the tube 81. Further details regarding the chemical and replenishment aspects of the process can be obtained from references such as the patents cited in the background section of the specification and in literature describing presently available processes for color film.

The intended process is carried out by immersing the film units in the respective chemical baths one-after-another to carry out a plurality of film-treatment steps which establish a visibly apparent image, such as a negative or transparency, from an original or latent image. Immersion of the film units is accomplished, without touching the walls of the tanks, by suspending the carrier 29, from its drive shaft 43, on selected notch pairs 83, 85, 87, in spaced parallel support bars 89 and 91. When the rack is so suspended, the film disks will be generally located in the respective chemical baths.

A single pair of notches is depicted with each tank, but additional pairs could be provided, for example, to increase the treatment time in selected tanks. In such case, of course, the positions of the notched pairs would have to be changed apropriately.

The high packing density of the film units on the spindle permits the use of smaller tanks which improve the efficiency of using the processing solution. The smaller tanks, in combination with other features, permit quicker transfer of the units from one tank to another.

After passing through the various chemical treatment steps, the film units are conditioned in a hot air dryer 93 (FIG. 4) for immediate handling and are deposited on exit ramp 95 for collection.

A loading station 97 (FIG. 4) also has been provided. As depicted in FIGS. 2 and 4, this station is essentially the same as a tank station, but with the tank removed.

The film units are conveyed between the respective notch pairs by a rack transport 101, which includes rectangular drive means 103, connecting bars 105, adjustable clamps 107, 108, 109, and 110, pairs of lifting bars 111, 112, 113, and 114 and a counter weight device 115. The drive means is an endless chain 117 coupled to a driving sprocket 119 and trained to follow a rectangular path by idler sprockets 120, 121, and 122. The chain is attached to the connecting bar 105 by a pin 123 so the bar will follow the chain in a rectangular path including an upward vertical leg corresponding to chain reach 124, a rightward horizontal leg corresponding to chain reach 125, a downward vertical leg corresponding to chain reach 126, and a leftward horizontal leg corresponding to chain reach 127.

Figure 3:
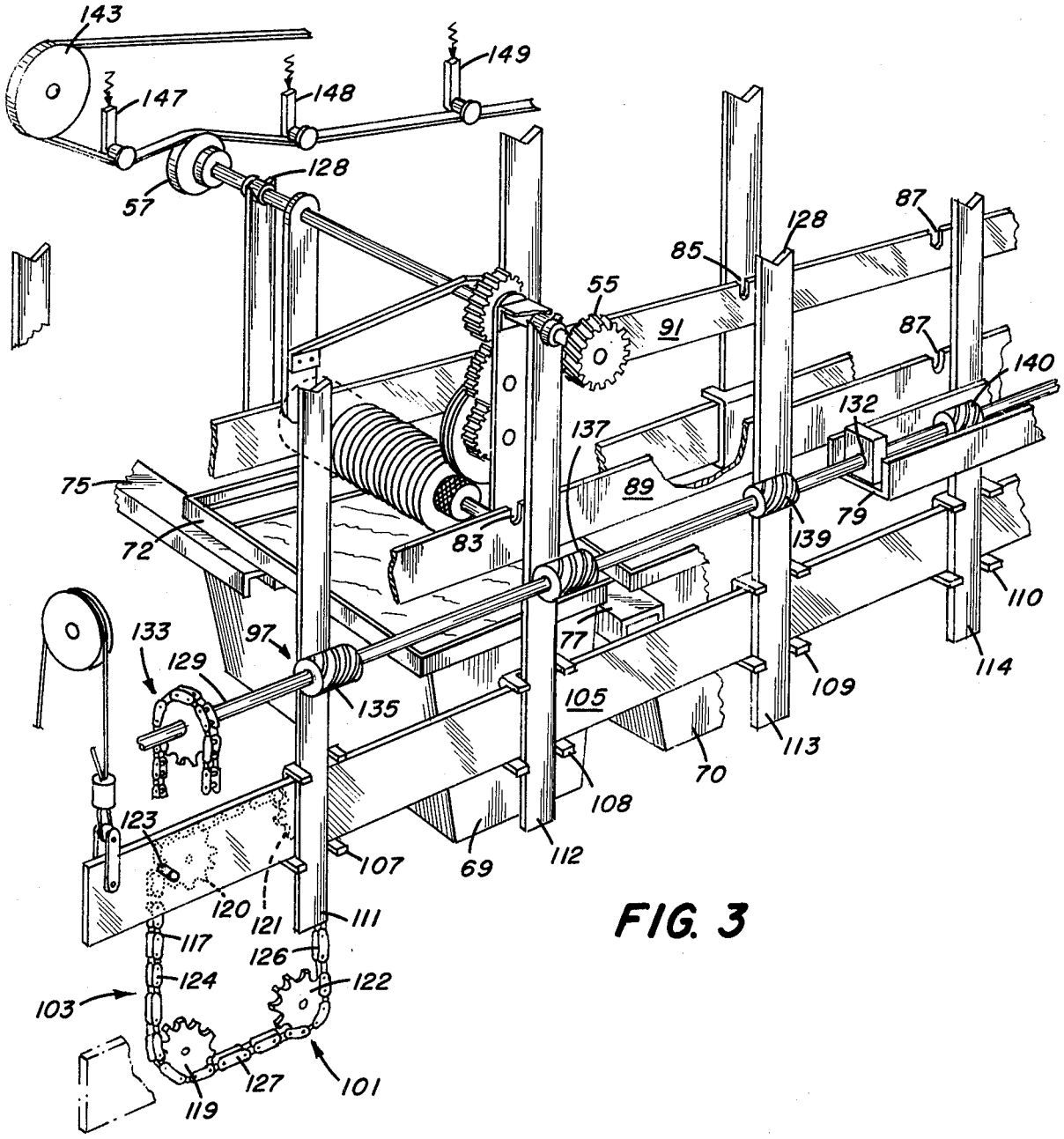
FIG. 3 is a partial perspective view similar to FIG. 2, but in a different stage in the processing sequence.

Although only one of the chains is depicted in FIG. 2 it should be understood that a second similar drive at the opposite end of the connecting bar 105 (see FIG. 4) operates in synchronism with the one shown in FIG. 2. Similarly, a second connecting bar (see FIG. 3) is provided on the opposite side of the tanks from, and operates in synchronism with, the connecting bar illustrated in FIG. 2.

The lifters 111, 112, 113 and 114 are spaced along the connecting bar 105 by a distance between adjacent lifters, i.e. 112 and 113, which is equal to the distance between adjacent notches, i.e. 83 and 85. When the connecting bar is in the position depicted in FIG. 2, one lifter pair will be postioned laterally adjacent each notch pair, and, as the pin 123 moves upwardly along the vertical reach 124, the forked ends 128 of one of the lifter pairs 112 will engage the carrier drive shaft 43, lifting the carrier and film disks from the tank 69 in which they were suspended (see FIG. 3).

The rightward horizontal reach 125 of the chain drive also is equal in length to the distance between adjacent notches, i.e. 83 and 85. Thus, as the pin continues in its rectangular path, after causing the forked lifters to raise the rack from one tank, the pin will move the connecting bar and forked lifters horizontally to position the rack over the next successive processing position. From this position the rack is lowered, as the pin 123 moves along vertical reach 126, the rack is deposited with its drive shaft 43 in the next notch pair 85, and the film units are suspended in the next tank 70. Completing the cycle, the forked lifters are disengaged from the rack, the pin 123 moves along the leftward horizontal reach 127, and the lifters are returned to the starting position depicted in FIG. 2.

Agitation of the film units in the chemical processing solutions is accomplished by rotating the spindle 19 while it is suspended in a respective tank. Rotation within the range of 5 to 400 RPM should provide suitable agitation, with 200 RPM being preferred. The agitation drive includes a rod 129, which is rotatably supported in bearings 130, 131, and 132, and driven by a chain and sprocket 133. A series of worms, 135, 137, 139 and 140 are spaced along the shaft 129, for meshing with and drivingly engaging the frame worm-gear 55 when the rack is suspended in one of the tanks. A bracket 142 is provided to engage the top of lifter 112 to prevent rotation of the rack in the raised condition.

In order to remove excess solution from the film units between successive tanks, a spin mechanism 141 is located to act on the rack in its raised position. This mechanism includes the drive pulley 143, belt 145 and tension devices 147, 148 and 149. When the rack is in its fully raised position depicted in FIG. 3, the belt 145 will drivingly engage rack pulley 57 and rotate the spindle at approximately 2000 RPM. Curtains or the like may be hung on the rack or between the respective tanks to redirect any solution removed in this manner back into the appropriate tank.

Referring now to FIG. 4, the overall operation of the processing apparatus is represented schematically with the carrier depicted in a number of selected positions occupied during its progression through the apparatus.

Beginning at the loading station 97, a plurality of the film units have been clamped on spindle 21, snapped into carrier 29 and positioned in the station 97. Although manual loading is depicted in the figure, the carriers can be queued on a ramp (not shown) similar to exit ramp 95, from which they could be released one-at-a-time to the position represented at 97.

From the loading position, the carrier is picked up by the lifter bars 111, moved to the right over tank 69 and then lowered to position "*a*," where the drive gear 55 is coupled to worm 137, and the spindle 21 is immersed horizontally in the first bath of processing solution.

The spindle is rotated in position "*a*" to agitate the film units in the first solution. This mixes the chemicals in the solution, improves the migration of the chemicals in the boundary layers between the film units and the solution, and disperses pockets starved of chemicals by the process.

The rack and film units remain in tank 69 while pin 123 of the transport drive travels from position "A" to position "B," and the lifter bar 112 moves horizontally to the left into position under the shaft 43 of the film rack 29. Then, as the pin continues to move in its rectangular path from "B" to "C," the lifter bar raises the rack and film units out of the tank 69 and into engagement with the squeegee drive at position "*c*."

In position "*c*," the spindle 21 and film units are rotated to remove excess processing solution before immersion in the next solution in tank 70. This reduces carryover to the next chemical bath. It also prevents spotting and uneven processing due to non-uniform retention of the solution on the film units.

As pin 123 of the transport drive continues to move, from "C" to "D," the squeegee drive 141 is discontinued and the carrier moves horizontally from "*c*" to "*d*." Then, from position "*d*" the carrier begins to drop for immersion in the next bath in tank 70.

The transport cycle is repeated from tank-to-tank and from agitation-drive-to-solution-removing drive until all of the liquid treatments are completed and the film units have passed through the dryer 93. From the dryer, the carrier and film units are deposited for collection on exit ramp 95.

Coordination of the various functions of the apparatus and timing of the process treatments can be accomplished in a number of ways including mechanical cams or other time cycling devices, electrical circuits including micro-processors and full-scale computers. In the illustrated embodiment, the agitation and solution-removing drives 135 and 145, and the drive chain 103, stop and start at programmed intervals. They could be operated continuously, however, in a mechanical cycle, so the processing times would be established by the configuration and speed of the respective parts.

It should now be apparent that the present invention provides unique structure which offers important advantages not previously available in photographic processors. High density processing can be combined with more efficient use of processing solutions and improved transport times. Dryer temperatures can be increased without causing furrows or craters. The necessary capital investment and space allocation for processing equipment can be reduced. Spin agitation can be more precisely specified in processing instructions and provides uniformly reproducible results. Centrifugal removal of the excess solution is believed to be more efficient than other methods under a variety of circumstances with no physical contact with the film base or emulsion. Perhaps most important, all of these advantages can be attained with no reduction in the quality of processing.

Although the invention has been described with particular reference to a preferred embodiment thereof, it will be readily understood that variations and modifications can be effected within the spirit and scope of the invention as described hereinabove and as defined in the appended claims.

I claim:

1. Apparatus for processing in successive baths of processing solutions a plurality of disc-shaped photographic film elements on a spindle, each respective element having a substantially flat imaging surface, the spindle supporting the elements with the imaging surfaces in closely spaced parallel relation relative to each other and defining a longitudinal axis passing through central sections of the elements; said apparatus comprising:

transport means for automatically conveying the spindle and thereby the film elements between the successive baths and for automatically immersing the elements edgewise, with the spindle axis horizontal, in one bath after another; and drive means for spinning the film elements about the spindle axis to agitate the elements in each respective bath.

2. Apparatus for processing in a plurality of treatment fluids a plurality of individual photographic film units supported on a spindle, each of the film units including at least one substantially flat imaging surface, the spindle defining a longitudinal axis and including means for securing the film units in side-by-side relation with the imaging surfaces parallel to each other and normal to the spindle axis; said apparatus comprising:

a plurality of containers for the treatment fluids;

means for automatically conveying the spindle between said respective containers, and for immersing the spindle and film units in each respective container, one container after another, with the spindle axis oriented horizontally; and drive means associated with each respective container for spinning the spindle immersed therein about its axis, thereby to agitate the film units in the treatment fluids.

3. Photographic processing apparatus for immersing film units having supports containing latent images in processing compositions to establish visibly perceivable images from the latent images, the film units being supported on a shaft defining a longitudinal axis, the shaft including means for supporting the film units with the latent-image supports of the film units generally normal to said axis; said apparatus comprising:

a plurality of fluid containers for the processing compositions;

means for conveying the shaft between said respective containers and for immersing the shaft with its axis oriented horizontally, successively, in one container after another;

drive means for spinning the shaft in said containers to agitate the film units in the processing compositions and for spinning said shaft between successive immersions of said shaft in said containers to evenly-spread and remove excess of the processing compositions from the film units.

4. Apparatus for processing photographic discs in a plurality of solution baths successively in one bath after another, each respective disc defining a substantially flat imaging surface and an aperture passing entirely through a central section of the disc; said apparatus comprising:

an elongate spindle for receiving the discs through the apertures and for supporting the discs with the imaging surfaces closely spaced in parallel relation relative to each other and normal to the longitudinal axis of the spindle;

transport means for automatically conveying said spindle and the discs between the solution baths and for automatically immersing the spindle and discs with the longitudinal axis of the spindle horizontal in one bath after another; and drive means associated with the solution baths for rotating said spindle and discs about the longitudinal axis of the spindle to agitate the discs in each respective bath.

5. Apparatus for simultaneously processing a plurality of individual photographic film units in a plurality of treatment fluids, the film units each including a relatively stiff support having a substantially flat imaging surface; said apparatus comprising:

an elongate spindle for receiving the film units, said spindle defining a longitudinal axis and including means for clamping the film units in side-by-side relation with the imaging surfaces parallel to each other and normal to said axis of rotation;

a plurality of containers for the treatment fluids, respectively;

means for automatically conveying said spindle between said respective containers and for immersing said spindle in each respective container, one container after another, with the spindle axis oriented horizontally; and drive means associated with each respective container for spinning said spindle about its axis to agitate the film units in the treatment fluids.

6. Photographic processing apparatus for immersing multiple exposure film units in processing compositions to establish visibly perceivable images from latent images in the film units, each film unit defining a planar element containing the latent images; said apparatus comprising:

an elongate shaft for receiving a plurality of the film units, said shaft defining a longitudinal axis and including means for supporting the film units with their planar elements generally normal to said axis;

a plurality of fluid containers for the processing compositions;

means for conveying said shaft between said respective containers and for immersing the shaft with the axis of rotation oriented horizontally in one container after another;

drive means for rotating said shaft in said containers to agitate the film units in the processing compositions and for rotating said shaft out of said containers to evenly-spread and remove excess of the processing compositions from the film units.

7. Apparatus for processing photographic film units in treatment fluids, each respective film unit defining a generally planar surface for images and an aperture passing entirely through the film unit normal to the surface; said apparatus comprising:

means for supporting the film units for rotation on a common axis, said supporting means including a spindle passing through the apertures for supporting the film units with their image surfaces normal to the axis of rotation;

a plurality of containers for the treatment fluids, respectively;

means for conveying said spindle between said respective containers and for immersing the spindle and the film units in one container after another with the axis of rotation oriented horizontally, and drive means for rotating said spindle about said axis of rotation in each respective container to agitate the film units in the treatment fluids and for rotating said spindle out of said containers during conveyance between respective containers to remove treatment fluid from the film units.

8. Processing apparatus for treating photographic discs successively in one solution bath after another to establish visible images from latent images on the photographic discs; the discs each having a centrally located aperture; said apparatus comprising:

a plurality of containers for the solution baths respectively, said containers arranged in line, one adjacent another, for successively treating the discs in one bath after another;

a disc carrier including an elongated shaft;

means for clamping the discs on said shaft with the shaft passing through the apertures;

means for supporting said shaft horizontally in an operative position in each of said containers;

means for automatically transporting said shaft successively from an operative position in one container to an operative position in another of said containers; and drive means for spinning said shaft in said operative positions to agitate the discs in said baths.

9. Apparatus for processing photographic discs, to establish projectable images from latent disc images; the discs having means defining a centrally located aperture; said apparatus comprising:

a plurality of baths of solutions arranged for treating the discs, said baths including a first bath and a second bath adjacent said first bath;

an elongated shaft for receiving the discs in side-by-side relation with said shaft passing through the apertures;

means for supporting said shaft horizontally in a plurality of positions including a first position wherein said shaft is disposed in said first bath and a second position wherein said shaft is disposed in said second bath;

transport means for conveying said shaft between said first and second positions along a path including a section external to said baths; and drive means for spinning said shaft while said shaft is supported in said first and second positions to agitate the discs in said first and second baths, and for spinning said shaft in the external path section to remove excess solution from the discs between said first and second baths.

10. Apparatus for simultaneously processing a plurality of individual photographic units to establish projectable images from latent images, each photographic unit comprising a flat generally circular support having a centrally located aperture therethrough; said apparatus comprising:

a plurality of containers for photographic treatment solutions arranged in line with one container adjacent another container for successively treating the photographic units in one solution after another;

a carrier including (1) an elongate spindle for accumulating the photographic units with said spindle passing through the apertures in the units, and (2) clamping means for maintaining the units on the spindle in side-by-side relation;

means for supporting said carrier in one position with said spindle horizontally disposed in one container and in a second position with said spindle horizontally disposed in a second container;

means for transporting said spindle from said one position to said second position along a path including a section external to the baths;

first drive means for spinning said spindle at a first angular velocity in said first and second positions to agitate the photographic units in said first and second containers; and second drive means for spinning said spindle at a second angular velocity during transport of the spindle along the external path section to remove excess treatment solution from the photographic units.

11. Apparatus for processing photographic film units, each comprising a relatively flat support having a centrally located aperture of irregular cross-section, said apparatus comprising:

a disc carrier, said carrier including a spindle for receiving a plurality of the film units thereon with the spindle extending through the apertures in the film units, a rotatable drive shaft, and a spindle hanger for rotatably suspending said spindle below said carrier drive shaft, said spindle having an irregular cross-section similar to that of the apertures, and said hanger including means for transmitting motion from said drive shaft to said spindle to rotate said spindle;

a plurality of containers for photographic treatment solutions, respectively, said containers configured to receive the spindle and film units fully immersed in solution and arranged for successively treating the film units in one container after another;

a plurality of means associated with said containers respectively; each of said means being operative for supporting said carrier in a predetermined position relative to its respective container with said drive shaft in a predetermined orientation above the container, and with said spindle suspended in the container for immersing the film units in the treatment solution of the container;

drive means for engaging said drive shaft in the predetermined orientations thereof to rotate said spindle to agitate the film units in the treatment solutions; and a transport for transporting said carrier between said predetermined positions, said transport including pairs of carrier lifters, one pair associated with each container and means for driving said lifters to move said carrier in a generally rectangular path including horizontal reaches extending between said containers and vertical reaches for inserting and removing said spindle into and from said containers.

12. Apparatus for processing photographic film discs, each disc comprising a relatively flat support having a centrally located aperture of irregular cross-section, said apparatus comprising:

a carrier, said carrier including (1) an elongate spindle for receiving the film discs thereon with the spindle passing through the apertures and the image surfaces normal to the spindle, (2) a carrier drive shaft, and (3) a hanger for rotatably suspending said spindle below said carrier drive shaft; said spindle having an irregular cross-section similar to that of the apertures, and said hanger including means for transmitting motion from said drive shaft to said spindle to rotate said spindle;

a plurality of containers for photographic treatment solutions, said containers configured to receive the spindle and film discs fully immersed in the solutions and arranged for successively treating the discs in one container after another;

means associated with each respective container for supporting said carrier in a predetermined position relative to said container with the drive shaft in a predetermined orientation above said container and with said spindle suspended in said container for immersing the film discs in the treatment solution;

first drive means adjacent each of said predetermined positions for engaging said drive shaft to rotate said spindle at a first angular velocity thereby to agitate the film discs in the treatment solutions;

second drive means above each of said containers for engaging said drive shaft to rotate said spindle at a second angular velocity thereby to evenly spread and remove the treatment solution from the film discs; and a transport for transporting said carrier between said predetermined positions and between said first and second drive means, said transport including pairs of carrier lifters, one pair associated with each container, and means for driving said lifters to move said carrier in a generally rectangular path including horizontal reaches extending between containers and vertical reaches extending between first and second drive means.

* * * * *

UNITED STATES PATENT AND TRADEMARK OFFICE

CERTIFICATE OF CORRECTION

PATENT NO. : 4,112,452

DATED : September 5, 1978

INVENTOR(S) : David Lynn Patton

It is certified that error appears in the above-identified patent and that said Letters Patent are hereby corrected as shown below:

Column 1, lines 27-29, delete "Ser. No. 774,719, entitled APPARATUS FOR SELECTIVELY VIEWING A PLURALITY OF RECORDING ELEMENTS," and insert therefor --is an improvement over the invention disclosed in cross-referenced application Serial No. 774,722, and--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*